United States Patent [19]

Putman et al.

[11] Patent Number: 4,931,809

[45] Date of Patent: Jun. 5, 1990

[54] MOUNTING ASSEMBLY FOR SATELLITE TRANSMITTING ANTENNA

[75] Inventors: Rob R. Putman, Moorpark, Calif.; Kevin George, Clifton, N.J.

[73] Assignee: Sony Corporation, Tokyo, Japan

[21] Appl. No.: 202,823

[22] Filed: Jun. 6, 1988

[51] Int. Cl.[5] ..... H01Q 1/12

[52] U.S. Cl. ..... 343/882; 343/892; 343/878; 343/713

[58] Field of Search ..... 343/882, 892, 878, 713, 343/715, 887; 248/200.1, 131, 415, 420

[56] References Cited

U.S. PATENT DOCUMENTS

| | | | |
|---|---|---|---|
| 874,435 | 12/1907 | Prescott | 248/415 |
| 3,896,447 | 7/1975 | Majkrzak | 343/709 |
| 4,652,890 | 3/1987 | Crean | 343/882 |
| 4,667,917 | 5/1987 | Takace | 248/415 |

FOREIGN PATENT DOCUMENTS

| | | | |
|---|---|---|---|
| 0103405 | 6/1984 | Japan | 343/878 |

*Primary Examiner*—Rolf Hille
*Assistant Examiner*—Hganganh Le
*Attorney, Agent, or Firm*—Alvin Sinderbrand

[57] ABSTRACT

A mounting assembly for supporting a satellite transmitting antenna on a truck or other mobile vehicle includes a base member having a lower mounting surface adapted to be fixed against a mobile vehicle surface, for example, an air fairing on top of the cab of the tractor portion of a trailer truck, a first pivot axis on the base member spaced upwardly from the mounting surface and extending parallel with the latter, an upper member having an upper surface to which the antenna is secured and a second pivot axis spaced downwardly from the upper surface and extending parallel therewith, and a strut connected, at its end portions, to the first and second pivot axes with the latter parallel to each other so that the upper surface and the lower mounting surface can be adjusted relative to each other both angularly and in respect to the distance therebetween for varying the height and orientation of the mounted antenna.

6 Claims, 4 Drawing Sheets

FIG. 2
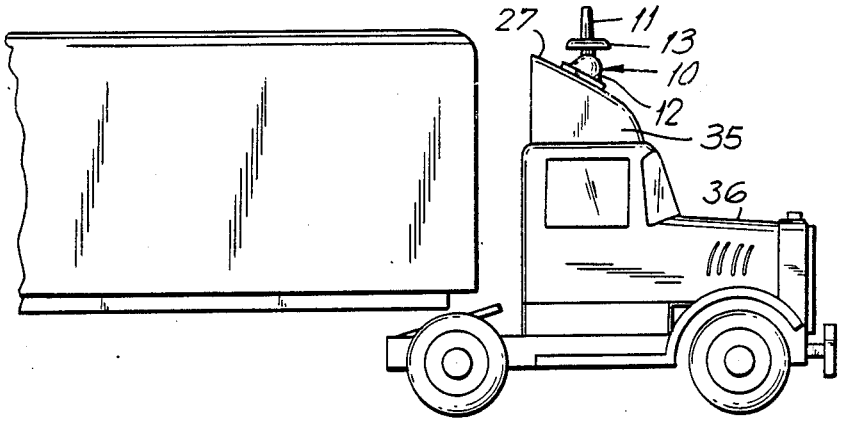
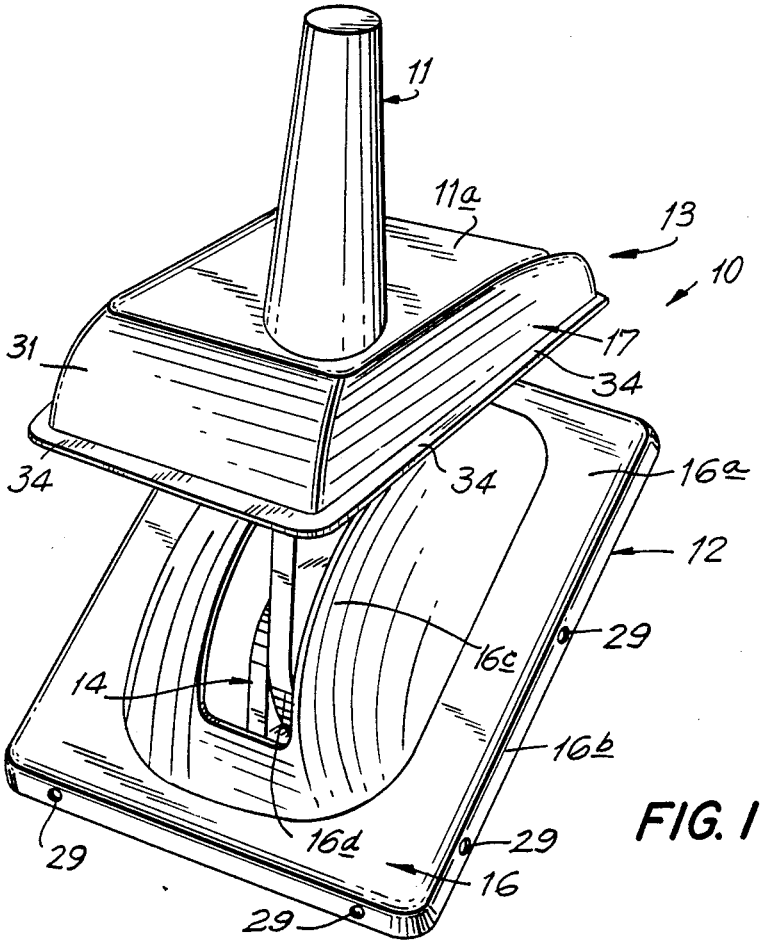
FIG. 1

MOUNTING ASSEMBLY FOR SATELLITE TRANSMITTING ANTENNA

BACKGROUND OF THE INVENTION

1. Field of the Invention

This invention relates generally to an antenna mounting assembly, and more particularly is directed to a mounting assembly for adjustably disposing a satellite transmitting antenna on a mobile vehicle.

2. Description of the Prior Art

It has been known to mount a satellite transmitting antenna on various modes of transport or mobile vehicles, including trucks, boats, buses, railroad cars and the like. Since a satellite transmitting antenna for radio direction finding requires an unimpeded line-of-sight to the respective satellite, it is necessary that the antenna be mounted at an elevated position on the respective mobile vehicle. The elevated positions on mobile vehicles at which the antennas are desirably mounted have various configurations so that, in the past, it has been necessary to provide specially designed mounting brackets adapted for mounting the satellite transmitting antennas on the various mobile vehicles. Such specially designed mounting brackets are quite obviously relatively costly and, in at least some instances, are relatively unsightly or poorly coordinated additions to the mobile vehicles on which they are secured.

OBJECTS AND SUMMARY OF THE INVENTION

Accordingly, it is an object of the present invention to provide a mounting assembly adapted for supporting a satellite transmitting antenna on differently configured surfaces, for example, on various mobile vehicles.

More specifically, it is an object of this invention to provide a mounting assembly for supporting a satellite transmitting antenna on various mobile vehicles or on differently configured surfaces thereof, and which is adjustable for conveniently maintaining a desired orientation and/or elevation of the supported antenna.

Still another object of this invention is to provide an antenna mounting assembly, as aforesaid, which is relatively inexpensive to produce.

A further object of this invention is to provide an antenna mounting assembly, as aforesaid, which is relatively attractive in appearance and complements the stream-lined formation of the various mobile vehicles on which it is adapted to be mounted, as well as being aerodynamically efficient for minimizing resistance to movement through the air with the vehicle.

In accordance with an aspect of this invention, a mounting assembly for supporting a satellite antenna on a mobile vehicle comprises a base member having a lower mounting surface adapted to be fixed against a surface of the mobile vehicle with means being directed upwardly from the lower mounting surface and defining a respective first pivot axis substantially parallel with the lower mounting surface; an upper member having an upper surface adapted to have the antenna secured thereagainst with means being directed downwardly from such upper surface and defining a respective second pivot axis substantially parallel with the upper surface; and a strut member pivotally connected, at spaced apart locations therealong, to the first and second pivot axes which are parallel with each other so that the upper surface and the lower mounting surface can be adjusted relative to each other both angularly and in respect to the distance therebetween.

In accordance with another aspect of this invention, the base and upper members include first and second brackets, respectively, which are of the same configuration and inverted relative to each other, with such first and second brackets having respective plates defining the mounting surface and the upper surface, respectively, at faces of the plates directed away from each other, and with lugs being directed normal to the faces of the plates which confront each other and carrying bolts which connect respective end portions of the strut member to the lugs and define the first and second pivot axes.

In accordance with still another aspect of this invention, the base and upper members further include first and second generally stream-lined fairings secured on the first and second brackets, respectively, with the first fairing including a lower outwardly directed portion covering the plate of the first bracket and an upwardly humped middle portion accommodating the lugs of the first bracket and having a slot therealong for passage of the strut member therethrough, and with the second fairing having a bottom wall portion secured between a pedestal portion of the antenna and the plate of the second bracket, and upwardly directed front and side wall portions extending along the front and sides, respectively of the bottom wall portion and substantially embracing the pedestal portion of the antenna.

The above, and other objects, features and advantages of the invention, will be apparent in the following detailed description of a preferred embodiment which is to be read in connection with the accompanying drawings, wherein corresponding parts are identified by the same reference numerals in the several views.

BRIEF DESCRIPTION OF THE DRAWINGS

FIG. 1 is a perspective view of a mounting assembly according to an embodiment of this invention, and which is shown with a satellite transmitting antenna secured thereon;

FIG. 2 is a side elevational view which, by way of example, shows the mounting assembly of FIG. 1 secured to an air fairing on top of the cab of the tractor portion of a trailer truck for supporting the satellite transmitting antenna thereon;

DESCRIPTION OF A PREFERRED EMBODIMENT

Figure 3:
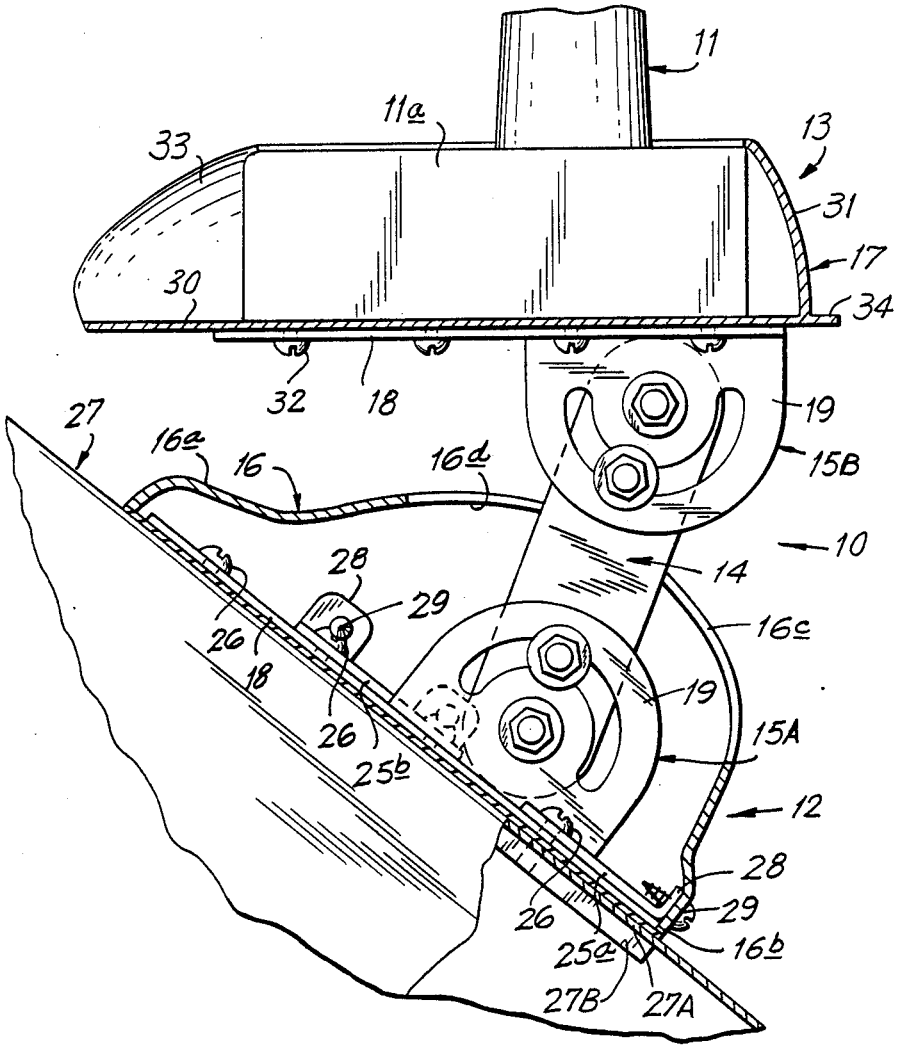
FIG. 3 is an enlarged side elevational view of the mounting assembly embodying this invention, with streamlined fairings included in such assembly being shown broken away and in section for more clearly illustrated internal structures of the mounting assembly.

Referring to the drawings in detail, and initially to FIGS. 1 and 3 thereof, it will be seen that a mounting assembly 10 according to an embodiment of this invention for supporting a satellite transmitting antenna 11 generally comprises a base member 12 adapted to be secured to a mobile vehicle, an upper member 13 adapted to have the antenna 11 secured thereto, and a strut member 14 adjustably connecting the members 12 and 13 so that the upper member 13, and hence the antenna 11 thereon, can have its orientation relative to the lower or base member 12, and also its distance from the latter, adjustably varied for accommodation to the various surfaces and mobile vehicles on which it may be desirable to mount the antenna 11.

As shown more specifically on FIG. 3, the base member 12 and upper member 13 include first and second brackets 15A and 15B, respectively, which are of the same configuration and inverted relative to each other, and first and second generally stream-lined fairings 16 and 17 secured on the first and second brackets 15A and 15B, respectively, as hereinafter described in detail, and substantially hiding the respective brackets from view.

Figure 4:
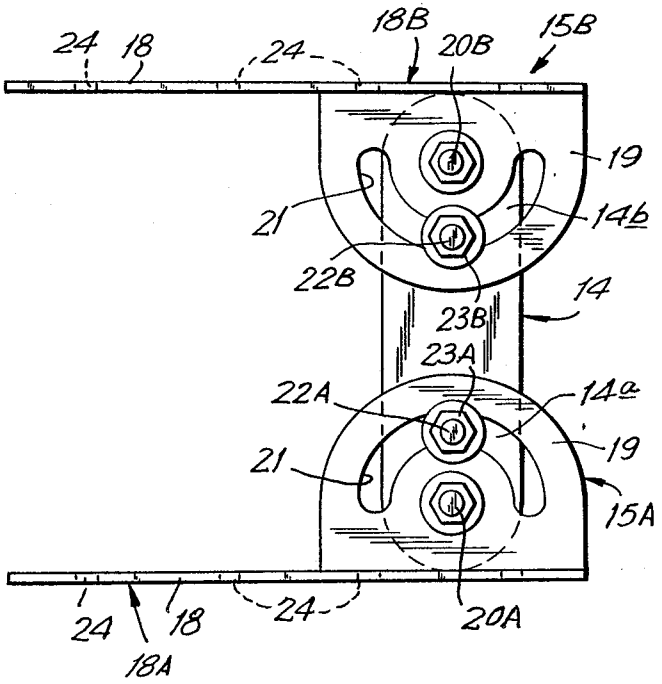
FIG. 4 is a side elevational view of a pair of brackets and a connecting strut which form important structural elements of the mounting assembly embodying the invention.
Figure 5:
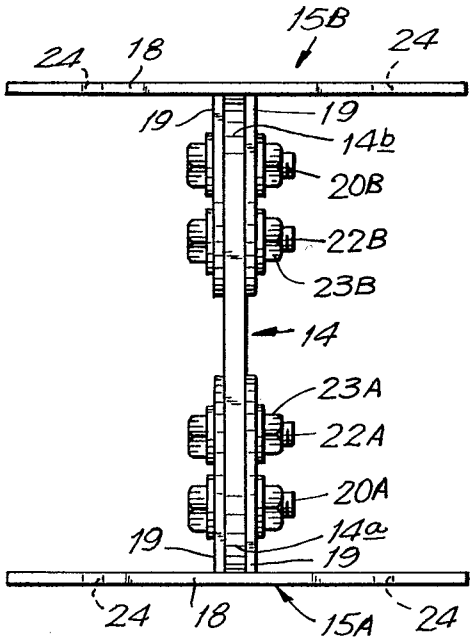
FIG. 5 is an end elevational view of the structural elements on FIG. 4.

As shown particularly on FIGS. 4 and 5, each of the first and second brackets 15A and 15B includes a substantially rectangular plate 18, and a pair of laterally spaced apart lugs 19 extending at right angles to the plane of the respective plate 18 at one end portion of the latter, and being laterally centered relative to the plate 18. The lugs 19 of each of the brackets 15A and 15B are shown to be substantially semi-circular and have extending therethrough, at their centers, respective bolts 20A and 20B which define first and second pivot axes opposite end portions **14*a* and 14*b* of the strut member 14 extend between the pairs of lugs 19 on the brackets 15A and 15B, respectively, and are pivotally connected to the latter by the bolts 20A and 20B. The lugs 19 of the brackets 15A and 15B have arcuate slots 21 extending therethrough and being concentric with the bolts 20A and 20B defining the respective pivot axes. Locking means, for example, in the form of bolts 22A and 22B, are carried by the end portions 14*a* and 14*b* of the strut member 14 and extend slidably through the arcuate slots 21 of the lugs 19 between which the respective end portions of the strut member are received. Locking nuts 23A and 23B are provided on threaded end portions of the bolts 22A and 22B, respectively. Thus, as shown on FIG. 4, 6 and 7, when the locking nuts 23A and 23B are loosened, brackets 15A and 15B and strut member 14 extending therebetween are free to be angularly displaced relative to each other about the pivot axes defined by the bolts 20A and 20B. However, when the locking nuts 23A and 23B are tightened, the respective lugs 19 are clamped against the end portions of the strut member 14 received therebetween so as to lock or secure the brackets 15A and 15B relative to the strut member 14. The plates 18 of brackets 15A and 15B are desirably provided with rows of holes 24 spaced apart along the opposite side portions thereof (FIGS. 4 and 5**) for receiving screws or other fasteners, as hereinafter described in detail.

As shown on FIGS. 1 and 3, the fairing 16 of the base member 12 includes a lower outwardly directed portion **16*a* terminating in a peripheral dependent flange 16*b* which covers and extends around the plate 18 of the bracket 15A, and an upwardly humped middle portion 16*c* which accommodates the lugs 19 of the bracket 15A (FIG. 3) and which has a slot 16*d* extending therealong for passage through such slot of the strut member 14**.

As shown on FIG. 3, a forward clip **25*a* and opposite side clips 25*b* may be secured on the plate 18 of bracket 15A, for example, by means of screws 26 extending through holes 24 of such plate for securing the latter against a surface 27 of a mobile vehicle. Such clips 25*a* and 25*b* are shown to have apertured, upstanding tabs 28 engageable against the inner surface of the flange 16*b* of fairing 16 and adapted to receive screws 29 (FIGS. 1 and 3) by which the fairing 16 is secured to the bracket 15A. A rubber or other elastomeric gasket 27A (FIG. 3) is desirably interposed between the plate 18 of bracket 15A and the surface 27 for accommodating variations in the latter from a flat plane. When the surface 27 is provided on a relatively thin sheet metal or fiberglass structure, such thin structure is desirably provided, at its underside, with a backing plate or plates 27B (FIG. B) into which the screws 26** may be threaded.

The fairing 17 of the upper member 13 is shown to have a substantially flat bottom wall portion 30 (FIG. 3) adapted to be secured between a pedestal portion **11*a* of the antenna 11 and the plate 18 of the bracket 15B by means of screws 32 extending through the holes 24 of such plate 18 and through aligned holes in the bottom wall portion 30 into suitably tapped bores in the pedestal 11*a* of the antenna 11. Thus, the screws 32 securing the antenna 11 to the plate 18 of the bracket 15B also function to secure the fairing 17 on the bracket 15B. It is further to be noted that the fairing 17 has suitably contoured front and side wall portions 31 and 33, respectively, directed upwardly from the front and sides of the bottom wall portion 30 and substantially embracing the antenna pedestal portion 11*a* at the front and sides for streamlining the same. Further, the edge portions of the bottom wall portion 30 may desirably extend beyond the front and side wall portions 31 and 33 to define lips 34** directed outwardly therefrom.

Figure 6:
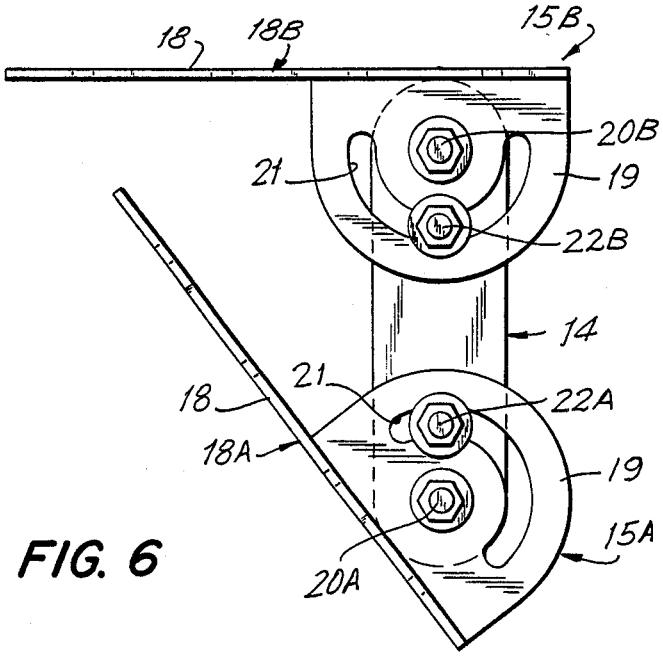
FIGS. 6 and 7 are side elevational views similar to that of FIG. 4, but showing the structural elements of the mounting assembly in different respective adjusted positions.
Figure 7:
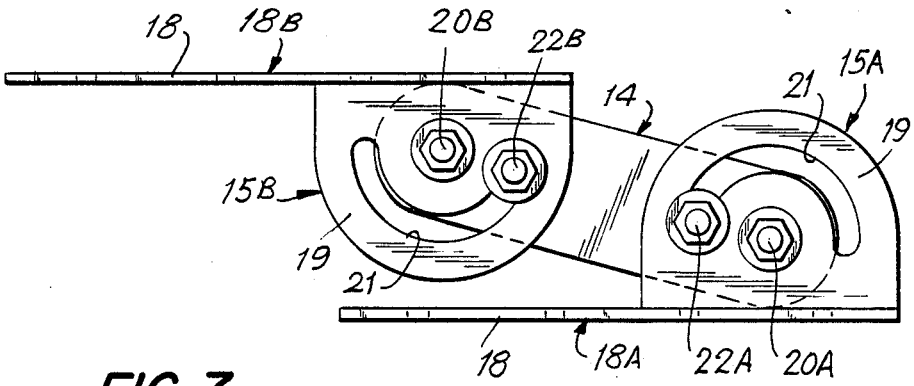

It will be appreciated from FIGS. 4, 6 and 7, that the underside of the plate 18 of the bracket 15A provides a lower mounting surface 18A of the mounting assembly which is adapted to be fixed against the surface 27 of a mobile vehicle, while the corresponding upwardly directed surface of the plate 18 of the bracket 15B defines an upper surface 18B adapted to have the antenna secured thereagainst, with the strut member 14 pivotally connected, at its end portions, to the pivot axes defined by the bolts 20A and 20B permitting the lower mounting surface 18A and the upper surface 18B to be adjusted relative to each other both angularly and in respect to the distance therebetween. By reason of the foregoing, the mounting assembly 10 according to this invention is adaptable for the mounting of the satellite transmitting antenna 11 on surfaces of mobile vehicles having various configurations. Thus, for example, as shown on FIG. 2, the mounting assembly 10 may be employed for mounting the antenna 11 at an elevated position on the sloping surface 27 of an air fairing 35 provided on top of the cab of a tractor portion 36 of a trailer truck. By angularly adjusting the bracket 15A relative to the strut 14, for example, between the position shown on FIG. 4 and the position shown on FIG. 6, the upper surface 18B against which the pedestal of the antenna 11 is secured can be maintained substantially horizontal, while the lower mounting surface 18A is disposed to conform to the inclination of the surface 27 of the air fairing 35. Further, by angularly displacing the strut 14 between the erect position shown on FIG. 4 and the steeply inclined position shown on FIG. 7, the elevation of the surface 18B above the mounting surface 18A can be varied, for example, for ensuring that the mounted antenna 11 will have an unimpeded line-of-sight to the respective satellite, or for ensuring that the distance from the ground to the top of the antenna 11 will not exceed the clearance of bridges, underpasses and the like along the route of the truck.

It is further to be noted that, by employing the brackets 15A and 15B which are identical, but mounted in inverted positions relative to each other, substantial economies are realized in the manufacture of the mounting assembly 10 according to this invention.

Furthermore, the streamlined fairings 16 and 17 forming parts of the base member 12 and the upper member 13, respectively, of the mounting assembly 10 improve the aerodynamic efficiency of the mounting assembly in minimizing the resistance to movement thereof through the air with the vehicle. Moreover, such fairings 16 and 17 are relatively attractive in appearance and complement the stream-lined formation of the various mobile vehicles on which the assembly 10 is likely to be mounted.

Although a precise embodiment of the invention has been described in detail herein with reference to the accompanying drawings, it is to be understood that the invention is not limited to that specific embodiment, and that various changes and modifications may be effective therein by one skilled in the art without departing from the scope or spirit of the invention as defined in the appended claims.

What is claimed is:

1. A mounting assembly for supporting a satellite antenna on a mobile vehicle, comprising:

a base member having a lower mounting surface for fixed mounting against a surface of the mobile vehicle, and means directed upwardly from said lower mounting surface and defining a respective first pivot axis substantially parallel with said lower mounting surface;

an upper member having an upper surface for fixed mounting of the antenna thereagainst, and means directed downwardly from said upper surface and defining a respective second pivot axis substantially parallel with said upper surface;

a strut member pivotally connected, at spaced apart locations therealong, to said first and second pivot axes with said axes being parallel with each other so that said upper surface and said lower mounting surface can be adjusted relative to each other both angularly and in respect to the distance therebetween for ensuring that a mobile vehicle on which said base member is fixed does not interfere with an unimpeded line-of-sight from an antenna mounted on said upper member to a respective satellite;

said base member and said upper member including first and second brackets, respectively, which are of the same configuration and inverted relative to each other, and which define said mounting surface and said upper surface, respectively, at faces of said brackets directed away from each other, and first and second generally streamlined fairings secured on said first and second brackets, respectively, and substantially hiding said brackets from view.

2. A mounting assembly according to claim 1; in which said first and second brackets have respective plates formed with said faces directed away from each other and lugs directed normal to the faces of said plates which confront each other and carrying bolts which connect respective ends of said strut member to said lugs and define said first and second pivot axes.

3. A mounting assembly according to claim 2; in which said first fairing includes a lower outwardly directed portion covering said plate of the first bracket and an upwardly humped middle portion accommodating said lugs of the first bracket and having a slot therealong for passage therethrough of said strut member.

4. A mounting assembly according to claim 3; in which said second fairing includes a bottom wall portion secured between a pedestal portion of the antenna and said plate of the second bracket, and upwardly directed front and side wall portions extending along front and side edge portions, respectively, of said bottom wall portion and substantially embracing said pedestal portion of the antenna.

5. A mounting assembly for supporting a satellite antenna on a mobile vehicle, comprising:

a first bracket including a plate with a lower mounting surface for fixed mounting against a surface of the mobile vehicle, and a pair of laterally spaced lugs directed upwardly from said plate normal to the plate and defining a gap between said lugs;

a second bracket of the same configuration as said first bracket so as to include a plate and a pair of laterally spaced lugs disposed normal thereto and defining a gap between the respective lugs, said second bracket being inverted relative to said first bracket so that said lugs of the second bracket extend generally downward from the respective plate which defines an upwardly facing mounting surface for the fixed mounting of the antenna thereon;

first and second bolts carried by said lugs of the first and second brackets, respectively, and extending across gaps between the respective lugs for defining first and second pivot axes;

a strut member having opposite end portions extending into said gaps defined between the lugs of said first and second brackets, respectively, and being pivoted on said first and second bolts, respectively, which are parallel with each other so that the plates of said first and second bracket can be adjusted relative to each other both angularly and in respect to the distance therebetween to adjusted positions for ensuring that a mobile vehicle on which said lower mounting surface is fixed does not interfere with an unimpeded line-of-sight from an antenna on said upwardly facing mounting surface to a respective satellite; and locking means carried by said strut member and engageable with said pair of lugs of each of said first and second brackets for securing the brackets in said adjusted positions.

6. A mounting assembly according to claim 5; in which said lugs have arcuate slots concentric with the respective pivot axes, and in which said locking means includes a locking bolt carried by each said end portion of the strut member and extending through said arcuate slots of the lugs between which said end portion is received, and a nut screwed on a threaded end of said locking bolt and being tightened for clamping said strut member between the respective lugs.

* * * * *

UNITED STATES PATENT AND TRADEMARK OFFICE

CERTIFICATE OF CORRECTION

PATENT NO. : 4,931,809

DATED : June 5, 1990

INVENTOR(S) : Rob R. Putman and Kevin George

It is certified that error appears in the above-identified patent and that said Letters Patent is hereby corrected as shown below:

On the cover sheet, item [73] should read:

-- Assignee: Sony Corporation of America
Park Ridge, New Jersey --

Signed and Sealed this

Twenty-fourth Day of September, 1991

*Attest:*

HARRY F. MANBECK, JR.

*Attesting Officer*

*Commissioner of Patents and Trademarks*